US006944921B1

(12) United States Patent
Gersten

(10) Patent No.: US 6,944,921 B1
(45) Date of Patent: Sep. 20, 2005

(54) BURIAL URN FOR A PLURALITY OF CREMATED REMAINS

(76) Inventor: Daniel J. Gersten, 29636 Quail Run Rd., Agoura Hills, CA (US) 91301

( * ) Notice: Subject to any disclaimer, the term of this patent is extended or adjusted under 35 U.S.C. 154(b) by 69 days.

(21) Appl. No.: 10/612,638

(22) Filed: Jul. 1, 2003

(51) Int. Cl.[7] ..... A61G 17/00
(52) U.S. Cl. ..... 27/1
(58) Field of Search ..... 27/1, 35; 52/136; 220/23.88

(56) References Cited

U.S. PATENT DOCUMENTS 4,977,652 A * 12/1990 Graham ..... 27/1
D396,749 S * 8/1998 Ortiz ..... D3/284
5,832,575 A * 11/1998 Sturino ..... 27/1
6,047,843 A * 4/2000 Mecke ..... 220/23.88
6,295,705 B1 * 10/2001 Gersten ..... 27/1
6,421,890 B1 * 7/2002 Biggar ..... 27/1
6,612,454 B1 * 9/2003 Lin ..... 220/23.88
2004/0098846 A1 * 5/2004 Glass ..... 27/1

* cited by examiner

*Primary Examiner*—William L. Miller
(74) *Attorney, Agent, or Firm*—Jack C. Munro

(57) ABSTRACT

A burial urn for cremated remains which utilizes a housing which has an internal chamber which is adapted to connect with a plurality of containers. The exterior side edge of the housing is formed polygonal shaped and is divided into a series of separate panels with there being a name plaque mounted on each panel. A single container is to align with a particular name plaque. Each container includes a removable lid to gain access into the container. The housing is to be closed by a cover which provides access to the containers.

5 Claims, 1 Drawing Sheet

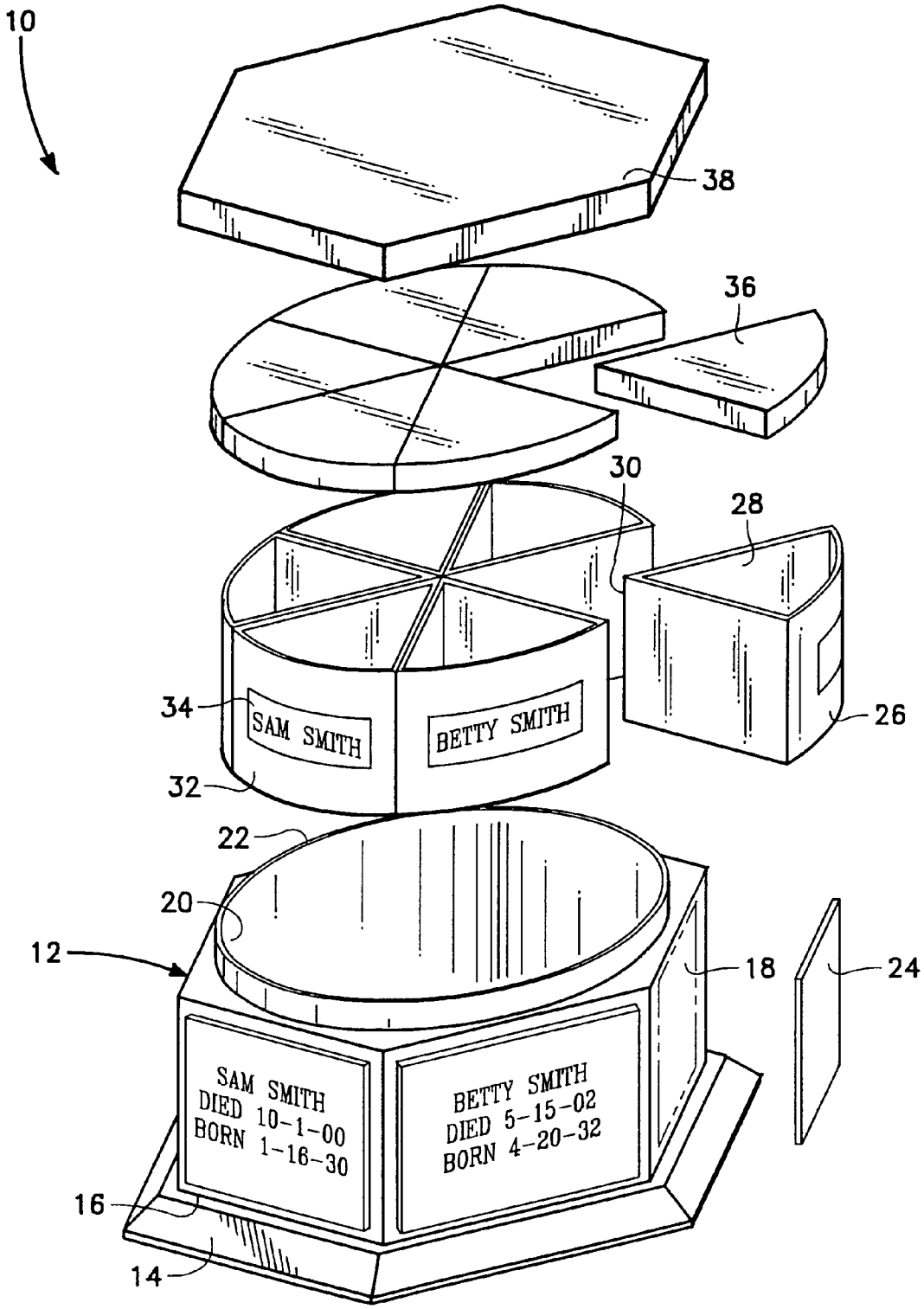
10
38
36
30
28
34
SAM SMITH
BETTY SMITH
26
32
22
20
12
18
24
SAM SMITH
DIED 10-1-00
BORN 1-16-30
BETTY SMITH
DIED 5-15-02
BORN 4-20-32
16
14

BURIAL URN FOR A PLURALITY OF CREMATED REMAINS

BACKGROUND OF THE INVENTION

1. Field of the Invention

The field of this invention relates to receptacles and more particularly to a burial urn which is adapted to contain the cremated remains of a plurality of family members or pets.

2. Description of the Related Art

Cremation of the mortal remains of living creatures, such as humans and pets, has become increasingly popular. The popularity of cremation is almost assuredly due to the fact that it is less expensive than being interred into the ground, and it may avoid storage charges if the remains are located within the individual's residence if not stored at some exterior location, such as in a mortuary. The end product of the cremation process, after removal of non-combustible materials and grinding, is a small volume of finely ground ash.

Disposal of this ash has taken many forms. One form would be to dispose of the ash into a sea, ocean, lake, or on land in a particular location. In such an instance, there is no need for a burial urn. However, some people choose to retain some or all of the cremated remains as constituting a memory of the loved one that has been lost. Typically, burial urns take the form of a vase or a similar type of container where the cremated remains of the lost loved one are to be placed. In some families where there have been a plurality of lost loved ones and this would mean that there is a plurality of separate containers that are stored somewhere within the individual's residence, or if it is stored at an exterior location, within a crematorium or cemetery.

There is a need to design an attractive urn for a plurality of cremated remains that will function to store all or a portion of the cremated remains of a plurality of family members with this burial urn adapted to be placed within one's home or business.

SUMMARY OF THE INVENTION

The primary objective of the present invention is to construct a burial urn which is designed to be utilized not only for a single individual but actually a plurality of individuals.

Another objective of the present invention is to construct a burial urn which is attractive in appearance and can be located within a person's residence.

Another objective of the present invention is to construct a burial urn for the cremated remains of loved ones of a single family which allows the living family members to have the deceased family members with the living family members throughout the years regardless of where the living family members move and reside.

Another objective of the present invention is to construct a burial urn that is designed to be both a receptacle for the combined cremated remains of loved ones as well as a log of who they were relative to the family, much like the family plot of yore.

Another objective of the present invention is to construct a burial urn which has inscribed thereon certain information of the deceased party, such as name, date of birth and date of death.

The basic embodiment of burial urn for a plurality of cremated remains of the present invention comprises a housing which has an internal chamber which is closed except for the top which is open. The housing has a polygonal exterior sidewall which is divided into a series of separate panels. Each panel is to have mounted thereon a name plaque with there being a plurality of name plaques on the housing. A plurality of containers are removably located within the internal chamber. Each container is to align with a particular name plaque with there being an equal number of containers to the number of the name plaques. Each container has an internal compartment into which a cremated remains is to be stored. There is a separate container lid for each container which is to function to close the internal compartment for the container to which it is connected. The container lid is to be removable from the container. A housing cover closes the internal chamber with the housing cover being removable to gain access to the container and the container lids. The housing cover connects with the top of the housing.

A further embodiment of the present invention is where the basic embodiment is modified by the internal chamber being circular in transverse cross-section.

A further embodiment of the present invention is where the basic embodiment is modified by each of the panels being of the same size.

A further embodiment of the present invention is where the basic embodiment is modified by the containers in total forming a close fit within the internal chamber.

A further embodiment of the present invention is where the basic embodiment is modified by there being included a name label on each container with a name on a label to correspond with identifying indicia formed on the name plaque with which it is aligned.

BRIEF DESCRIPTION OF THE DRAWINGS

For a better understanding of the present invention, reference is to be made to the accompanying drawings. It is to be understood that the present invention is not limited to the precise arrangement shown in the drawings.

The FIGURE comprises an exploded isometric view of the burial urn for a plurality of cremated remains of the present invention.

DETAILED DESCRIPTION OF THE INVENTION

Referring particularly to the drawing, there is shown the burial urn 10 of this invention. The burial urn 10 comprises a housing 12 which is defined by a polygonal shaped base 14 from which upwardly extends a sidewall 16. The sidewall 16 is polygonal shaped and is formed into a plurality of panels 18. In the embodiment 10, there is shown to be six in number of the panels 18. However, it is considered to be within the scope of this invention that the number of panels 18 could be increased or decreased.

The housing 12 has an internal chamber 20. The internal chamber 20 has an open top 22 but is closed at the bottom and at its sidewall. The internal chamber 20 is enclosed by the panels 18. The internal chamber 20 is shown to be of a circular configuration taken in transverse cross-section that is when observed in plan view relative to the open top 22. It is considered to be within the scope of this invention that the internal chamber 20 could be other than circular, it just being that circular is the preferable shape.

A name plaque 24 is designed to be adhesively secured onto each respective panel 18. It is to be understood that there is a separate name plaque 24 for each panel 18. The name plaque 42 comprises a thin, flat, rectangularly shaped piece which could be formed of metal, plastic or wood.

Inscribed on the exterior surface of the name plaque is identifying indicia, such as a name of a person that has passed on, the date of birth of the person and the date of death plus other information is such is desired.

A series of containers 26 each have an internal compartment 28. The containers 26 are basically wedge shaped, and when connected together with the wedge points 30 all located in close proximity, the containers 26 define a circular array. The containers 26 can then be located in a close fitting manner within the internal chamber 20. The height of the containers 26 are all identical and is slightly less than the height of the sidewall of the internal chamber 20. The exterior surface 32 of each container 26 is to have mounted thereon an identifying label 34. The label 34 is to have inscribed thereon indicia which is to correspond to the indicia that is inscribed on the name plaque with which it is aligned when located within the internal chamber 20. This so that the ashes for the particular individual will correspond precisely to the identifying indicia on the name plaque 24 and so it will not be mixed up and misaligned with a different individual and a different name plaque 24. There is to be an equal number of the containers 26 to the panels 18.

It is desirable to normally close each container 26. For this purpose there is provided a container lid 36. The container lid 36 is to be removable in order to add ashes within the internal compartment 28 so such can be stored. Once the right amount of ashes are supplied within the internal compartment 28, the lid 36 is then mounted on the container 26. The lid 26 could be fixedly mounted on the container 26 although such is not normally necessary. In order to cover the open top 22 after all the containers 26 are located within the internal chamber 20, there is provided a sheet material cover 38. The cover 38 will engage with the open top 22 and is removable to provide access to the container 26 and lids 36.

The subject matter of this invention is discussed in conjunction with humans but could also be used for pets.

What is claimed is:

1. A burial urn for a plurality of cremated remains comprising:

a housing having an internal chamber which is closed except for the top which is open, said housing having a polygonal exterior surface divided into a series of separate panels, each said panel having mounted thereon a name plaque with there being a plurality of name plaques on said housing;

a plurality of containers being removably located within said internal chamber, each said container to align with a said name plaque with there being an equal number of containers to the number of said name plaques, each said container having an internal compartment into which a cremated remains is to be stored;

a separate container lid for each said container, each said container lid to function to close a said internal compartment; and a housing cover closing said internal chamber, said housing cover engaging with said top, said housing cover being removable to gain access to said containers and said container lids.

2. The burial urn for a plurality of cremated remains as defined in claim 1 wherein:

said internal chamber being circular in transverse cross-section.

3. The burial urn for a plurality of cremated remains as defined in claim 1 wherein:

all of said panels being of the same size.

4. The burial urn for a plurality of cremated remains as defined in claim 1 wherein:

all of said containers closely fit within said internal chamber.

5. A burial urn for a plurality of cremated remains comprising:

a housing having an internal chamber which is closed except for the top which is open, said housing having a polygonal exterior surface divided into a series of separate panels, each said panel having mounted thereon a name plaque with there being a plurality of name plaques on said housing;

a plurality of containers being removably located within said internal chamber, each said container to align with a said name plaque with there being an equal number of containers to the number of said name plaques each said container having an internal compartment into which a cremated remains is to be stored;

a separate container lid for each said container, each said container lid to function to close a said internal compartment;

a housing cover closing said internal chamber, said housing cover engaging with said top, said housing cover being removable to gain access to said containers and said container lids; and each said container having a name label mounted thereon, said name label is to have a corresponding identical name that it is to be inscribed on said name plaque and is to be in alignment with said name plaque.

* * * * *